US006059456A

United States Patent [19]

May

[11] Patent Number: 6,059,456

[45] Date of Patent: May 9, 2000

[54] RECLOSABLE PROFILE ARRANGEMENT USING SLIDABLE CLOSURE STRIP

[75] Inventor: Timothy J. May, Greenville, Wis.

[73] Assignee: Reynolds Consumer Products, Inc., Appleton, Wis.

[21] Appl. No.: 08/842,280

[22] Filed: Apr. 23, 1997

[51] Int. Cl.[7] ..... B65D 33/16

[52] U.S. Cl. ..... 383/63; 383/64; 383/65; 383/69; 24/415; 24/437

[58] Field of Search ..... 24/415, 437, 399, 24/400; 383/5, 61, 63–65, 68, 69

[56] References Cited

U.S. PATENT DOCUMENTS

| | | | |
|---|---|---|---|
| 1,371,934 | 3/1921 | Reynolds | 383/69 X |
| 2,623,665 | 12/1952 | Priamos | 383/68 X |
| 2,994,469 | 8/1961 | Troup et al. . | |
| 3,346,883 | 10/1967 | Ersek | 383/69 X |
| 3,991,801 | 11/1976 | Ausnit | 383/61 |
| 4,541,117 | 9/1985 | Ashbeck | 383/64 |
| 4,787,755 | 11/1988 | Branxon | 383/68 X |
| 5,007,143 | 4/1991 | Herrington . | |
| 5,067,208 | 11/1991 | Herrington et al. . | |
| 5,167,608 | 12/1992 | Steffens, Jr. et al. . | |
| 5,211,482 | 5/1993 | Tilman | 383/61 X |
| 5,301,395 | 4/1994 | Richardson et al. . | |
| 5,330,269 | 7/1994 | Kamada et al. | 383/5 X |
| 5,349,724 | 9/1994 | Braco Barcina et al. | 24/30.5 R |
| 5,442,837 | 8/1995 | Morgan . | |
| 5,492,411 | 2/1996 | May | 383/5 |

FOREIGN PATENT DOCUMENTS

| | | | |
|---|---|---|---|
| 456277 | 11/1991 | European Pat. Off. | 383/61 |
| 78 14 090U | 9/1978 | Germany . | |
| 423 606 | 5/1967 | Switzerland . | |

*Primary Examiner*—Jes F. Pascua
*Assistant Examiner*—Robin A Hylton
*Attorney, Agent, or Firm*—Alan M. Biddison

[57] ABSTRACT

A closure arrangement for a flexible package includes two base strips having channels and film-attachment portions, and a closure strip inserted within and slidably engaging the channels of the base strips. The closure arrangement includes shoulders on the channels configured to engage and retain the outer portions of the closure strip. The closure strip slides within the channels of the base strips to open and close the closure arrangement. A package and method of constructing a package are also described.

23 Claims, 6 Drawing Sheets

FIG. 4
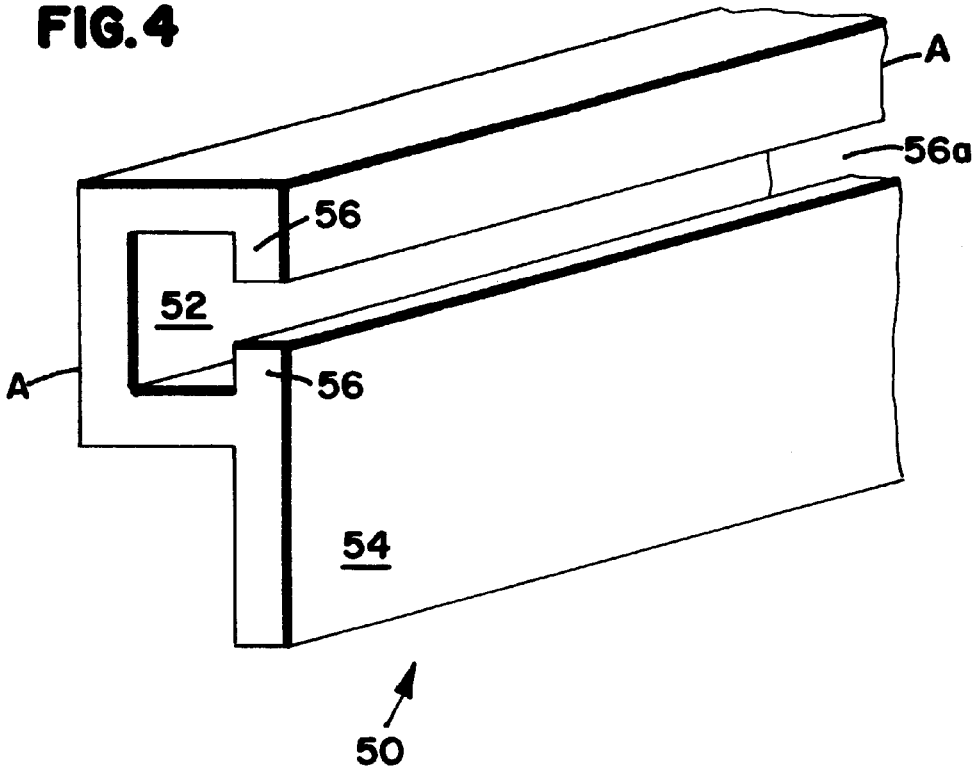
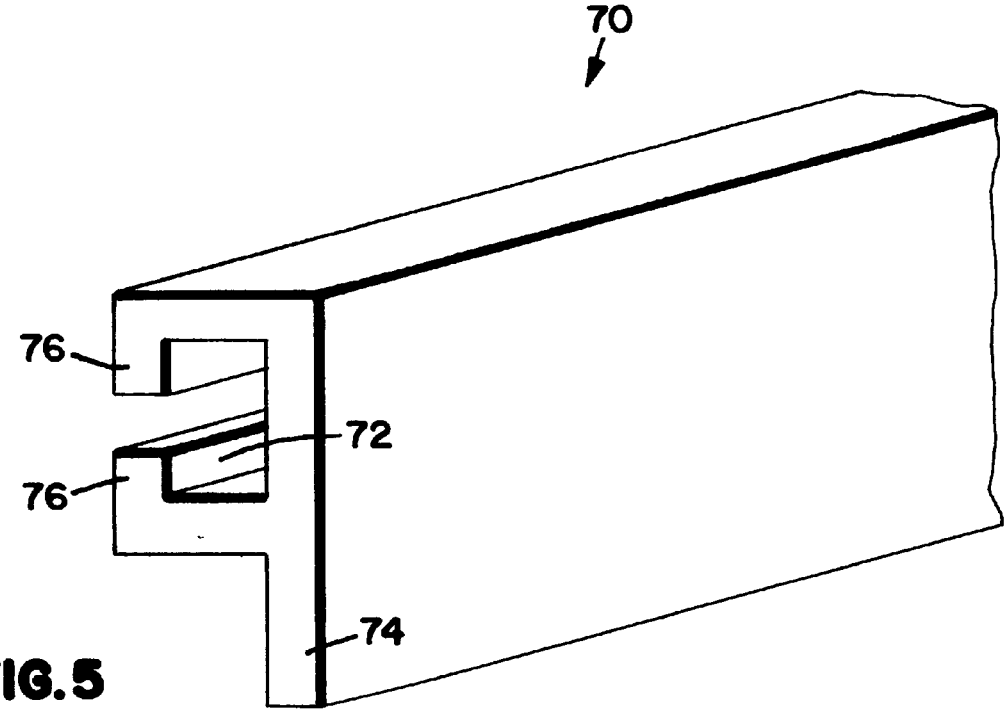
FIG. 5

FIG. 8
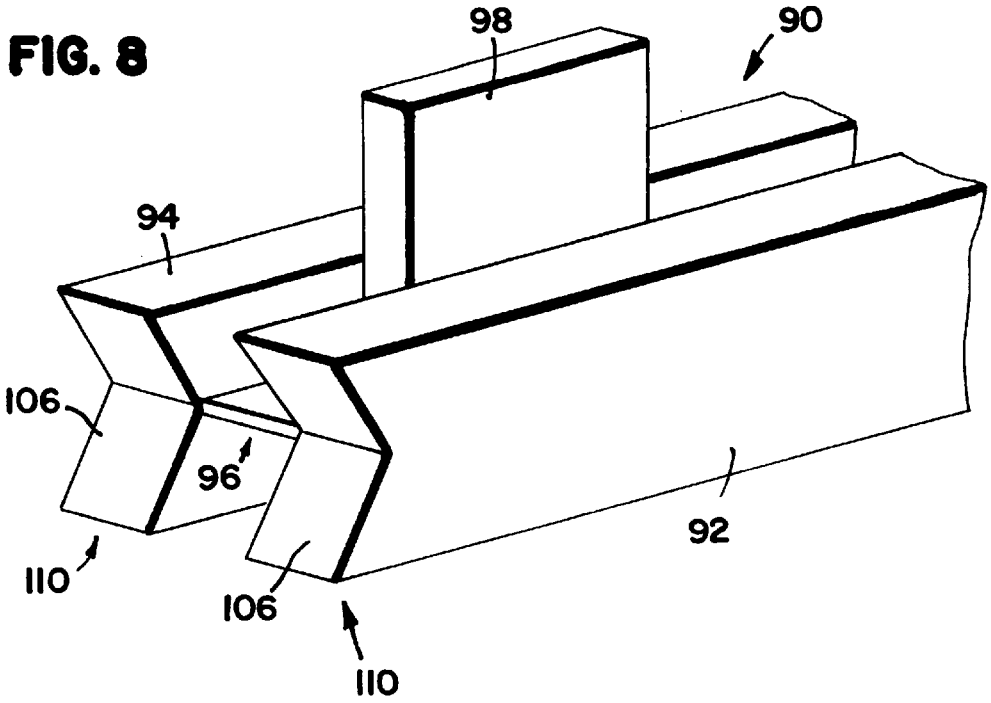
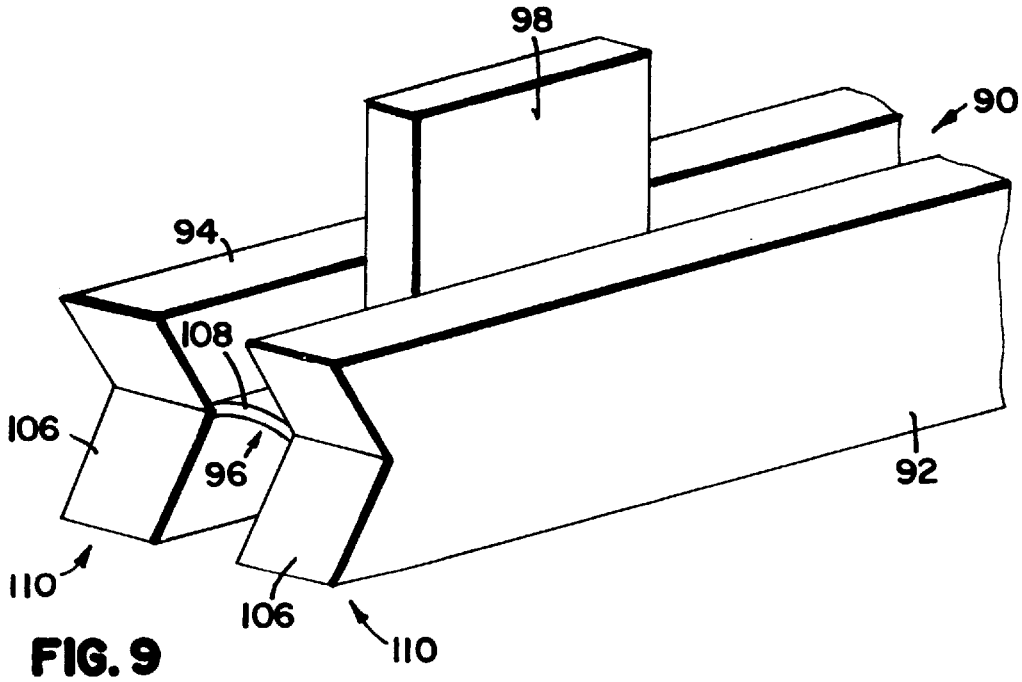
FIG. 9

RECLOSABLE PROFILE ARRANGEMENT USING SLIDABLE CLOSURE STRIP

FIELD OF THE INVENTION

The present invention relates to a closure arrangement for a flexible package and methods thereof. More particularly, the invention is directed to a flexible package having an interlocking profile with two base strips and a closure strip positioned between the base strips.

BACKGROUND

Flexible packages, often implemented using polymeric film and commonly referred to as "plastic bags", are useful for storing numerous different articles and materials. In some applications it is desirable that the packages be able to be opened and closed repeatedly. Such packages, generally referred to as "reclosable packages", frequently utilize zipper profiles having two or more interlocking profiles that lock to one another by the insertion of a "male profile" into a "female profile". Using such techniques, it is possible to create a tightly sealing package that can be opened and closed many times.

One disadvantage with existing zipper profiles is that they have difficulty closing if the profiles are obstructed or contaminated by powders or other small-sized particulate matter. For example, sugar or salt that finds its way into the volume formed by two or more legs of a female profile can prevent the sealing of the male and female profiles to one another since the male profile is not able to enter the female profile. Even if the particulate contamination is insufficient to wholly prevent the sealing of the male and female profiles, it can greatly diminish the efficacy of the seal or create a seal which will inadvertently open.

Types of particulate matter that can obstruct the operation of a traditional zipper profile include both food and non-food items. Examples of food items that will obstruct a traditional zipper profile include sugar, salt, flour, spices, powdered drink mixes, pancake and other baking batters, cereals, etc. Non-food items that will obstruct a traditional zipper profile include fertilizers, road-salt, soil, cement, plaster, sand, etc. The problems with these particulate materials is increased when the flexible package in which they are used is opened and closed repeatedly, since additional contaminants can enter and accumulate within the profile after each closure and opening cycle.

Consequently, a need exists for a closure arrangement for a flexible package which will effectively seal a package containing a powdered or particulate substance.

SUMMARY OF THE INVENTION

The present invention is directed to a reclosable profile arrangement for a flexible package. The reclosable profile arrangement is constructed and arranged to permit a flexible package to be repeatedly opened and closed even though it contains a particulate material. The particulate material may come in contact with the profile arrangement when the flexible package is in an open position without preventing the subsequent closure of the flexible package. Also, the particulate material may come in contact with the profile arrangement when the flexible package is in a closed position, without preventing the subsequent opening or reclosing of the arrangement.

An embodiment constructed in accordance with the principles of the present invention has a first base strip, a second base strip, and a closure strip. The first base strip and second base strip each include channels and first film-attachment portions. The closure strip includes first and second portions configured and arranged to insert within and slidably engage and retain the first and second base strips.

In an implementation of the present invention, the channels include one or more shoulders configured and arranged to sealingly engage and retain the first portion and second portion of the closure strip.

In a specific embodiment, the closure strip further comprises a closure tab proximate the first and second portions of the closure strip. The closure tab is constructed and arranged to provide a handle to assist in opening and closing the profile arrangement. In one embodiment, the closure tab is positioned proximate a first end of the closure strip.

In another embodiment, a second closure tab is positioned proximate a second end of the closure strip. The second closure tab is constructed and arranged to assist in opening the closure arrangement. In one implementation, the first closure tab is positioned proximate a top surface of the closure strip and the second closure tab is positioned proximate an end of the closure strip. The first and second closure tabs are constructed and arranged to provide handles to assist in the opening and closing of the profile arrangement.

In specific implementations, the reclosable profile arrangement is constructed of a polymeric material selected from the group consisting of low density polyethylene, high density polyethylene, and polypropylene. The first base strip and second base strip are sealed together at a first end and a second end in certain implementations.

The first and second portions of the closure strip may have a rectangular or oval cross section. In certain implementations, the closure arrangement forms an air-tight seal between the first base strip and the closure strip, and between the second base strip and the closure strip. The film-attachment portions of the first and second base strips may include a flange extending below the first channel and second channel.

In certain specific implementations, the first portion and second portion of the closure strip include inclined ends configured and arranged to lift and remove material from the first channel and second channel during closure of the profile arrangement. The first portion and second portion of the closure strip are joined to each other by an intermediate portion configured and arranged with a tapered end to direct material away from the first channel and second channel. In some embodiments, a tear-seal is positioned between the first base strip and second base strip.

The invention includes a reclosable package arrangement having a first base strip, a second base strip, a closure strip, and a packaging film. The first base strip includes a first channel and a film-attachment portion. The second base strip is positioned substantially opposite the first base strip and includes a second channel and a second film-attachment portion. The closure strip includes a first portion and a second portion. The packaging film is secured to the first base strip at the first film-attachment portion and the second base strip at the second film-attachment portion. The first portion of the closure strip is configured and arranged to insert within and slidably engage and retain the first channel, and the second portion of the closure strip is configured and arranged to insert within and slidably engage and retain the second channel.

A method of making a reclosable package is also disclosed. The method includes providing a first base strip including a first channel and a first film-attachment portion, providing a second base strip positioned substantially opposite the first base strip and including a second channel and a second film-attachment portion; providing a closure strip including a first portion and a second portion; and securing the first base strip to a packaging film at the first film-attachment portion and securing the second base strip to the packaging film at a second film-attachment portion. The first portion of the closure strip is configured and arranged to insert within and slidably engage and retain the first channel, and the second portion of the closure strip is configured and arranged to insert within and slidably engage and retain the second channel.

In certain implementations, the step of providing a closure strip further comprises providing a closure tab proximate the first portion and second portion, the closure tab constructed and arranged to provide a handle to assist in opening and closing the profile arrangement. In other implementations, the step of providing a closure tab includes providing a closure tap positioned proximate a first end of the closure strip.

The above summary of the present invention is not intended to describe each discussed embodiment of the present invention. This is the purpose of the figures and the detailed description which follow.

BRIEF DESCRIPTION OF THE DRAWING

Other aspects and advantages of the invention will become apparent upon reading the following detailed description and references to the drawings, in which:

FIG. 4 is an enlarged fragmentary view of a first base strip constructed in accordance with the present invention.

FIG. 5 is an enlarged fragmentary view of a second base strip constructed in accordance with the present invention.

FIG. 8 is an enlarged fragmentary view of the end of a closure strip constructed in accordance with the present invention, showing the end of the closure strip with ramped ends.

FIG. 9 is an enlarged fragmentary view of the end of a closure strip constructed in accordance with the present invention, showing the end of the closure strip with a tapered central portion.

While the invention is susceptible to various modifications and alternative forms, specifics thereof have been shown by way of example and drawings, and will be described in detail. It should be understood, however, that the intention is not to limit the invention to particular embodiments described. On the contrary, the intention is to cover modifications, equivalents, and alternatives falling within the spirit and scope of the invention as defined by the appended claims.

DETAILED DESCRIPTION

The present invention is generally applicable to closure arrangements for flexible packages, and is particularly beneficial for polymeric bags for holding particulate products.

Figure 1:
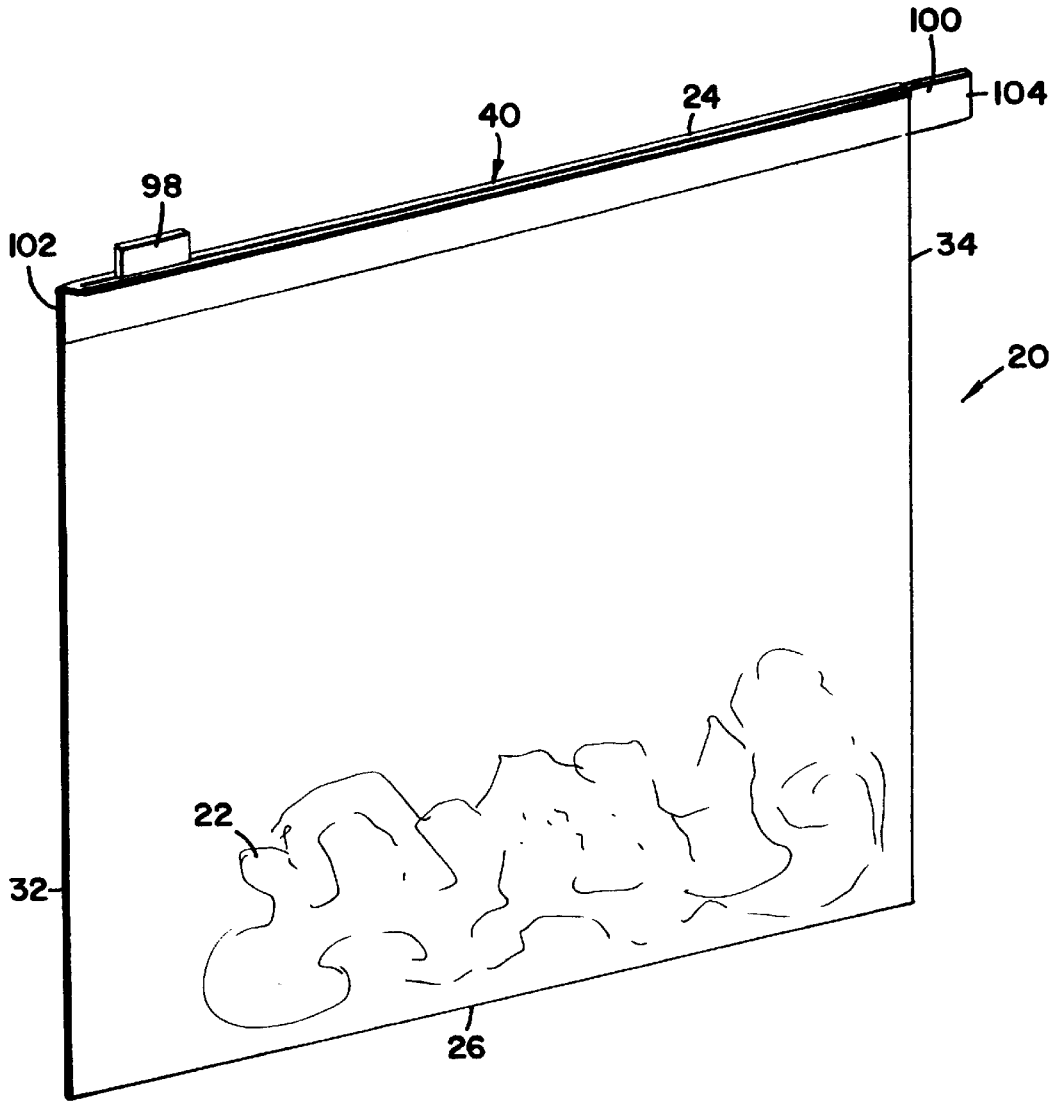
FIG. 1 is a perspective view of a flexible package constructed and arranged with a reclosable profile arrangement in accordance with one embodiment of the present invention, showing the profile arrangement in a closed position.

Referring now to the figures, one embodiment of the present invention is illustrated in FIG. 1 in the form of a flexible package, and is generally designated as 20. Flexible package 20 includes a reclosable profile arrangement 40. In the embodiment depicted in FIG. 1, the profile arrangement 40 is positioned proximate the top 24 of the flexible package 20. Flexible package 20 includes a first edge 32, a second edge 34, and a bottom 26. Profile arrangement 40, shown in a closed position in FIG. 1, includes a first closure tab 98 and a second closure tab 100. The flexible package 20 shown in FIG. 1 is in a generally closed position such that the closure tab 98 is positioned near edge 102 of the closure arrangement 40.

Figure 2:
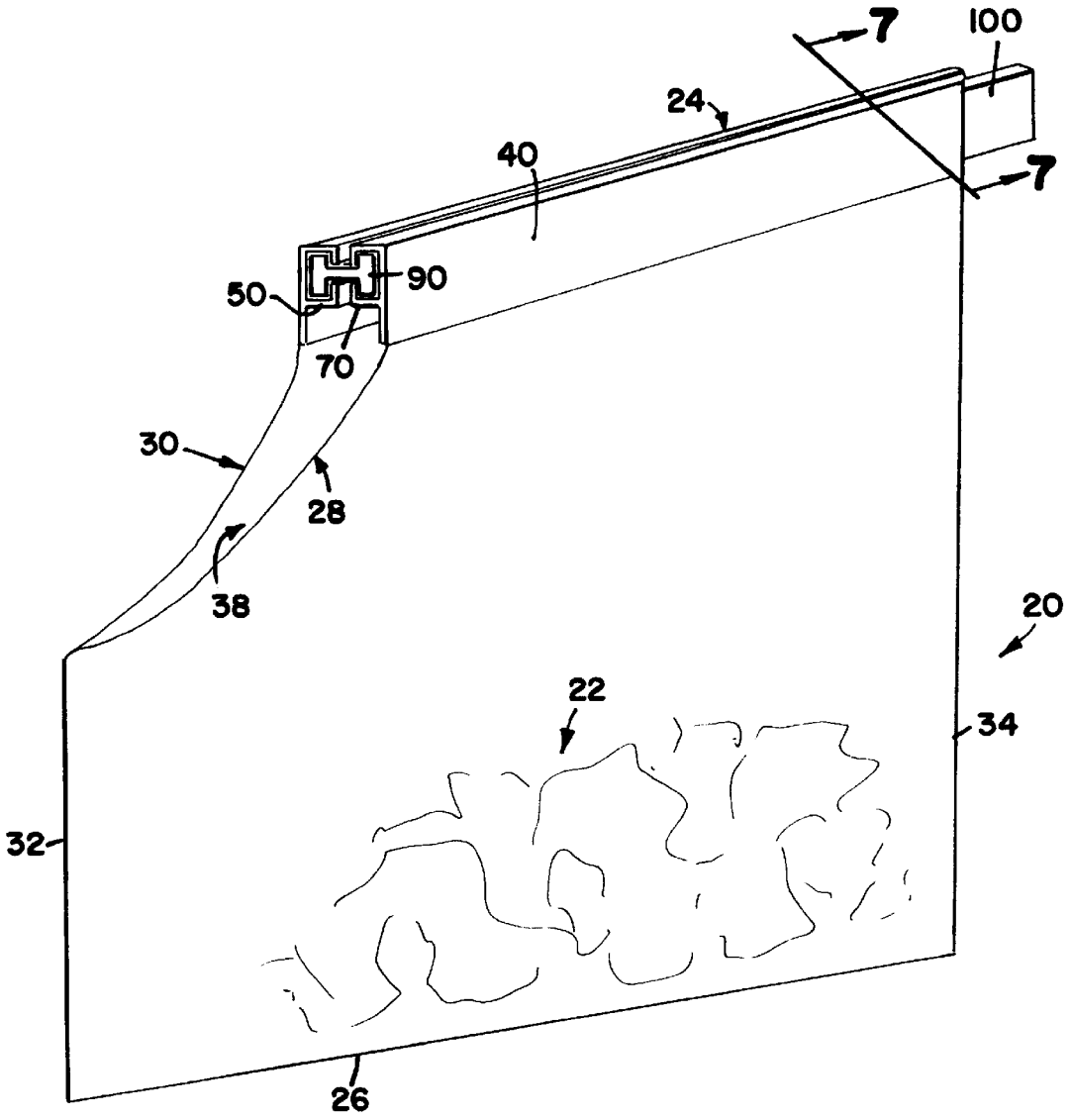
FIG. 2 is a fragmentary perspective view of a flexible package constructed and arranged in accordance with the present invention, showing a cut-away view of the reclosable profile in a closed position with the closure strip positioned between the first and second base strips
Figure 3:
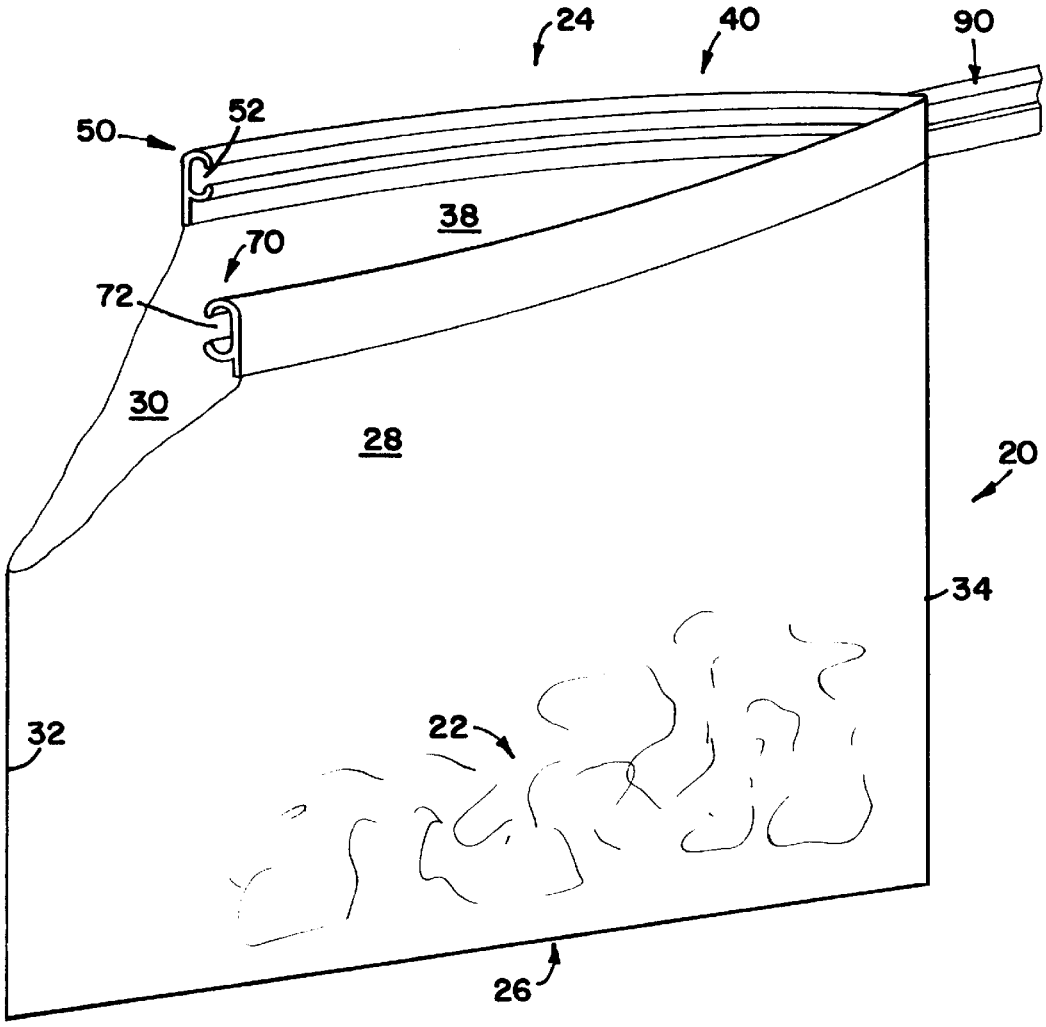
FIG. 3 is a fragmentary perspective view of a flexible package constructed and arranged in accordance with the present invention, showing a cut-away view of the reclosable profile in an open position.

Referring now to FIG. 2 and FIG. 3, the flexible package 20 of FIG. 1 is shown in fragmentary views depicting the reclosable profile arrangement 40 in a closed (FIG. 2) and a opened (FIG. 3) position. In FIG. 2, the closed profile arrangement 40 includes a first base strip 50 and a second base strip 70 substantially opposite one another. The closure strip 90 is positioned between the base strips 50, 70, and retains the base strips 50, 70 proximate one another. The flexible package films 28, 30 are secured to the base strips 70 and 50, and create a barrier preventing the escape of the particulate material 22 when the profile arrangement 40 is closed. Profile arrangement 40 is opened by pulling closure tab 98 toward edge 34, or pulling closure tab 100 away from flexible package 20 (FIG. 1 and FIG. 3).

The closure strip 90 retains the base strips 50, 70 by drawing the base strips 50, 70 toward one another. Closure strip 90, in conjunction with base strips 50 and 70, prevents the exit of particulate material 22 from within the flexible package 20. In order to open flexible package 20 , the tab 100 may be pulled away from the package 20 to partially or fully withdraw the closure strip 90 from the base strips 50, 70. Once the closure strip 90 has been removed, the base strips 50 and 70 may be withdrawn from one another and access to the interior of the flexible package 20 is gained.

In FIG. 3, the flexible package 20 with reclosable profile arrangement 40 shown in FIG. 2 is depicted in an open position, with the first and second base strips 50, 70 separated from one another. Access to the interior 38 of the flexible package 20 is provided, and product 22 may be added or removed from the package 20. The reclosable profile arrangement 40 is opened by withdrawing the closure strip 90 from the channels 52, 72 of the first and second base strips 50, 70. The closure strip 90 is shown in fragmentary view in FIG. 3, and the strip 90 is almost completely removed from the channels 52, 72.

Referring now to FIG. 4 and FIG. 5, first base strip 50 and second base strip 70 are depicted in enlarged perspective views. In FIG. 4, the channel 52 of base strip 50 includes a pair of opposing shoulders 56. The shoulders 56 retain the first and second locking portions of the closure strip within the channels (FIG. 2). The shoulders 56 permit the locking portions of the closure strip to be inserted and removed along axis A—A, but prevent the removal of the locking portion along the gap 56*a* between the shoulders 56.

In other embodiments of the present invention, only one shoulder 56 is present. Channel 52 has a substantially rectangular cross section in the embodiment depicted in FIG. 4, but other configurations are possible. For example, as shown in FIG. 3, the channels 52, 72 may have a substantially oval shaped cross section. The channels 52, 72 may be various different shapes that provide slidable retention of the locking portions 92, 94. The cross section of the channel 52 is configured and arranged to receive and retain the locking portion of the closure strip 90. A film-attachment portion 54 is indicated, and provides a surface for securing the base strip 50 to a flexible packaging material. The film-attachment portion 50 may be secured to the flexible packaging material, such as films 28, 30 depicted in FIG. 3, by heat sealing, adhesives, or other methods known to those of skill in the art.

Referring now to FIG. 5, a second base strip 70 is depicted in enlarged perspective view. In the depicted implementation, second base strip 70 includes a channel 72 with shoulders 76 and a film attachment portion 74. As noted in connection with FIG. 4, while a pair of opposing shoulders 76 are illustrated in FIG. 5, one shoulder may be utilized.

Figure 6:
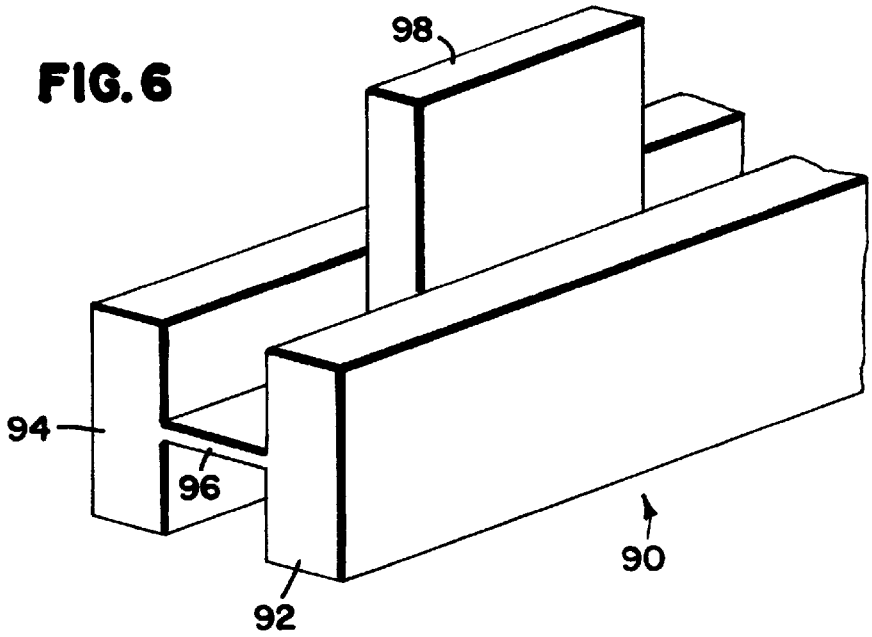
FIG. 6 is an enlarged fragmentary view of the end of a closure strip constructed in accordance with the present invention, showing a closure tab.

A fragmentary view of the end of a closure strip 90 is depicted in FIG. 6. A first locking portion 92 and a second locking portion 94 are provided on opposite sides of the closure strip 90. First and second locking portions 92, 94 are configured to fit within the channels 52, 72 of the base strips 50, 70 (FIG. 2). The locking portions 92, 94 slide within the channels 52, 72 to create a reclosable seal formed when the locking portions 92, 94 are within the channels (FIG. 2). In one implementation of the present invention, the locking portions 92, 94 have slightly smaller cross-sectional dimensions than the corresponding channels 52, 72, in order to prevent blockage of the profile arrangement 40 during opening and closing of the profile arrangement 40. In another implementation of the present invention, the closure strip 90 is constructed with locking portions 92, 94 the same size as the channels 52, 72.

Figure 7:
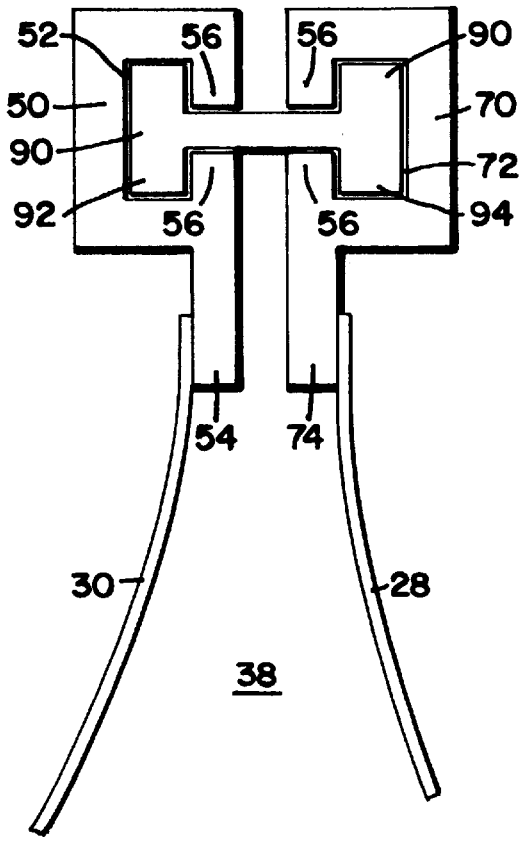
FIG. 7 is a cross-sectional view of a closure arrangement, taken through line 7—7 of FIG. 2, constructed in accordance with the present invention, showing the closure strip positioned between the first and second base strips.

A cross sectional view of a reclosable profile arrangement constructed in accordance with the present invention is shown in FIG. 7, taken along line 7—7 of FIG. 2. The closure strip 90 is positioned within the channels 52, 72 of the base strips 50, 70. Shoulders 56, 76 retain the first and second locking portions 92, 94 of the closure strip 90 within the channels 52, 72. The locking portions 92, 94 are retained by the shoulders 56, 76 such that the first and second base strips 50, 70 can not be separated from one another unless the closure strip 90 is slid out from between them.

In one embodiment, the locking portions 92, 94 are slightly larger than the channels 52, 72 so as to form a friction fit between the channels and locking portions, thereby forming a tighter seal. The materials used to construct the locking portions 92, 94, the channels 52, 72, or the locking portions and the channels, are constructed in one embodiment of a material with sufficient flexibility to form a seal between the locking portions and the channels even when particulate material is present within a portion or all of the channels. In yet another embodiment of the present invention, the locking portions are constructed with a slightly smaller cross-sectional profile than the channels of the base strips, so as to more easily slide within the channels.

The cross sectional view in FIG. 7 also shows films 28, 30 secured to the film attachment portions 54, 74 of base strips 50, 70. The interior volume 38 of the flexible package 20 is shown in fragmentary view.

Referring now to FIGS. 8 and 9, enlarged fragmentary views of a closure strip 90 constructed in accordance with implementations of the present invention are depicted. In FIG. 8, the closure tab 98 is shown positioned between the first locking portion 92 and second locking portion 94. These locking portions 92, 94 function as legs for insertion into the channels 52, 72 of the base strips 50, 70 shown generally in FIGS. 2 and 3. An intermediate portion 96 divides the locking portions 92, 94 from one another in the implementation shown in FIG. 8.

The ends 110 of the closure strip 90 depicted in FIG. 9 include inclined or angled surfaces 106 that assist in removing particulate matter from the first and second channels 52, 72 of the base strips 50, 70. The inclined surfaces 106 remove the particulate matter by lifting it out of the channels as the closure strip is reinserted into channels 52 and 72.

In FIG. 9, closure strip 90 also includes first and second locking portions 92, 94 along with intermediate portion 96 and ends 110. The intermediate portion 96 includes an end 108 which is tapered inward to further assist in removing particulate matter from the channels 52, 72. The tapered end 108 directs the particulate matter towards the center of the closure strip 90, from where it may fall back into the flexible package 20 (FIGS. 1–3).

The material 22 within the flexible package 20 may be of varying types and constitution. Material 22 may include, for example, various particulate and powdered food products, such as sugar, salt, flour, baking powders, pancake batter, and cereals. Alternatively, the material 22 may be a particulate or powdered non-food product, such as fertilizer, cement, plaster, seeds, sand, gravel, road-salt, and soil.

In certain embodiments, the first base strip 50, second base strip 70, and closure strip 90 are formed of a polymeric material. Suitable polymeric materials include high density polyethylene, low density polyethylene, and polypropylene. In specific implementations the base strips 50, 70 are constructed of the same material as the closure strip 90, while in other implementations the closure strip 90 and base strips 50, 70 are constructed of different materials.

While the present invention has been described with reference to several particular implementations, those skilled in the art will recognize that many changes may be made hereto without departing from the spirit and scope of the present invention.

I claim:

1. A reclosable profile arrangement for a flexible package, the arrangement comprising:

a first base strip including a first channel;

a second base strip positioned substantially opposite the first base strip and including a second channel; and a closure strip including a first locking portion configured and arranged to insert within and slidably engage and retain the first channel, and a second locking portion configured and arranged to insert within and slidably engage and retain the second channel, said first locking portion and said second locking portion of the closure strip being joined to each other by an intermediate portion configured and arranged with a tapered end to direct material away from the first channel and second channel.

2. The reclosable profile arrangement of claim 1, wherein the first channel includes at least one shoulder for engaging and retaining the first locking portion and the second channel includes at least one shoulder for engaging and retaining the second locking portion.

3. The reclosable profile arrangement of claim 1, wherein the closure strip further comprises a closure tab proximate the first portion and second portion, the closure tab constructed and arranged to provide a handle to assist a user in opening and closing the profile arrangement.

4. The reclosable profile arrangement of claim 3, wherein the closure tab is positioned proximate a first end of the closure strip.

5. The reclosable profile arrangement of claim 4, further comprising a second closure tab positioned proximate a second end of the closure strip, the second closure tab constructed and arranged to assist in opening the closure arrangement.

6. The reclosable profile arrangement according to claim 1, further comprising:

a first closure tab positioned proximate a top surface of the closure strip and configured and arranged to provide a handle to assist in the opening and closing of the profile arrangement; and a second closure tab positioned proximate an end of the closure strip and configured and arranged to provide a handle to assist in the opening and closing of the profile arrangement.

7. The reclosable profile arrangement according to claim 1, wherein the closure arrangement is constructed of a polymeric material selected from the group consisting of low density polyethylene, high density polyethylene, and polypropylene.

8. The reclosable profile arrangement according to claim 1, wherein the first and second portions of the closure strip have a rectangular cross section.

9. The reclosable profile arrangement according to claim 1, wherein the closure arrangement forms an air-tight seal between the first base strip and the closure strip, and between the second base strip and the closure strip.

10. The reclosable profile arrangement according to claim 1, further comprising a film-attachment portion extending below the first channel and second channel.

11. The reclosable profile arrangement according to claim 1, wherein the first portion and second portion of the closure strip include inclined ends configured and arranged to lift and remove material from the first channel and second channel during closure of the profile arrangement.

12. A reclosable polymeric profile arrangement for a flexible package, the arrangement comprising:

a first base strip including a first channel having a shoulder and a first film-attachment portion;

a second base strip positioned substantially opposite the first base strip and including a second channel having a shoulder and a second film-attachment portion; and a closure strip including a first leg portion configured and arranged to insert within the first channel and be retained by the shoulder of said first channel, and a second leg portion configured and arranged to insert within the second channel and be retained by the shoulder of the second channel, and an intermediate portion joining the first leg portion and second leg portion, the first leg portion and second leg portion of the closure strip being joined to each other by an intermediate portion configured and arranged with a tapered end to direct mateiral away from the first channel and second channel.

13. The reclosable profile arrangement of claim 12, wherein the closure strip further comprises a closure tab proximate the first leg portion and second leg portion, the closure tab constructed and arranged to provide a handle to assist in opening and closing the profile arrangement.

14. The reclosable profile arrangement of claim 13, wherein the closure tab is positioned proximate a first end of the closure strip.

15. The reclosable profile arrangement according to claim 12, further comprising:

a first closure tab positioned proximate a top surface of the closure strip and configured and arranged to provide a handle to assist in the opening and closing of the profile arrangement; and a second closure tab positioned proximate an end of the closure strip and configured and arranged to provide a handle to assist in the opening and closing of the profile arrangement.

16. The reclosable profile arrangement according to claim 12, wherein the first leg portion and second leg portion of the closure strip include inclined ends configured and arranged to lift and remove material from the first channel and second channel during closure of the profile arrangement.

17. A reclosable package arrangement comprising:

a first base strip including a first channel and a first film-attachment portion;

a second base strip positioned substantially opposite the first base strip and including a second channel and a second film-attachment portion;

a closure strip including a first portion and a second portion; and a packaging film secured to the first base strip at the first film-attachment portion and the second base strip at the second film-attachment portion;

wherein the first portion of the closure strip is configured and arranged to insert within and slidably engage and retain the first channel, and the second portion of the closure strip is configured and arranged to insert within and slidably engage and retain the second channel, and wherein the first portion and second portion of the closure strip are joined to each other by an intermediate portion configured and arranged with a tapered end to direct material away from the first channel and second channel.

18. The reclosable package arrangement of claim 17, wherein the closure strip further comprises a closure tab proximate the first portion and second portion, the closure tab constructed and arranged to provide a handle to assist in opening and closing the profile arrangement.

19. The reclosable package arrangement of claim 17, wherein the closure tab is positioned proximate a first end of the closure strip.

20. The reclosable package arrangement according to claim 17, further comprising:

a first closure tab positioned proximate a top surface of the closure strip; and a second closure tab positioned proximate an end of the closure strip;

wherein the first and second closure tabs are constructed and arranged to provide handles to assist in the opening and closing of the profile arrangement.

21. The reclosable package arrangement according to claim 17, wherein the first portion and second portion of the closure strip include inclined ends configured and arranged to lift and remove material from the first channel and second channel during closure of the profile arrangement.

22. The reclosable package arrangement according to claim 17, wherein the packaging film is a polymeric film.

23. A reclosable profile arrangement for a flexible package, the arrangement comprising:

a first base strip including a first channel positioned on one side thereof;

a second base strip positioned substantially opposite the first base strip and including a second channel on one side thereof, the first channel and the second channel being on confronting sides of the first and second base strips; and a closure strip having at least a portion thereof positionable between the confronting sides of the first and second base strips, the at least a portion of the closure strip when positioned between the first and the second base strip including a first locking portion configured and arranged to insert within and slidably engage and retain the first channel, and a second locking portion configured and arranged to insert within and slidably engage and retain the second channel, said first locking portion and said second locking portion of the closure strip being joined to each other by an intermediate portion at least partially positioned between the first base strip and the second base strip.

* * * * *